US005837924A

United States Patent [19]

Austin

[11] Patent Number: 5,837,924

[45] Date of Patent: Nov. 17, 1998

[54] SIGNAL TRANSMISSION TUBE USING RECLAIM MATERIAL AND METHOD OF MANUFACTURE

[75] Inventor: Dennis K. Austin, Simsbury, Conn.

[73] Assignee: The Ensign-Bickford Company, Simsbury, Conn.

[21] Appl. No.: 561,615

[22] Filed: Nov. 21, 1995

[51] Int. Cl.[6] ..... C06C 5/04; F42B 3/00

[52] U.S. Cl. ..... 102/275.8; 102/331; 102/275.4; 102/275.6; 102/275.11; 264/3.4

[58] Field of Search ..... 102/275.4, 275.5, 102/275.8, 275.11, 331; 264/3.4

[56] References Cited

U.S. PATENT DOCUMENTS

| | | | |
|---|---|---|---|
| 754,830 | 3/1904 | Trayssac | 86/22 |
| 922,343 | 5/1909 | Schulman | 102/275.6 |
| 3,586,551 | 6/1971 | Nolan | 149/124 |
| 3,590,739 | 7/1971 | Persson | 102/27 |
| 3,968,723 | 7/1976 | Flaterman et al. | 86/1 A |
| 4,018,636 | 4/1977 | O'Neill et al. | 149/19.4 |
| 4,024,817 | 5/1977 | Calder, Jr. et al. | 102/275.8 |
| 4,328,753 | 5/1982 | Kristensen et al. | 102/275.5 |
| 4,376,666 | 3/1983 | Williams, Jr. | 149/109.6 |
| 4,493,261 | 1/1985 | Simon et al. | 102/275.8 |
| 4,607,573 | 8/1986 | Thureson et al. | 102/275.8 |
| 4,614,208 | 9/1986 | Skarelius | 138/103 |
| 4,757,764 | 7/1988 | Thureson et al. | 102/312 |
| 4,991,511 | 2/1991 | Simpson | 102/275.6 |
| 5,166,470 | 11/1992 | Stewart | 102/275.5 |
| 5,208,419 | 5/1993 | Greenhorn et al. | 102/275.4 |
| 5,211,777 | 5/1993 | Nahlovsky et al. | 149/109.6 |
| 5,212,341 | 5/1993 | Osborne et al. | 102/275.8 |
| 5,220,107 | 6/1993 | Kubacki | 149/124 X |
| 5,249,685 | 10/1993 | Stephens | 206/523 |
| 5,317,974 | 6/1994 | Stewart et al. | 102/275.8 |
| 5,509,355 | 4/1996 | Stewart et al. | 102/275.8 |
| 5,629,493 | 5/1997 | Andersson et al. | 102/275.8 |

*Primary Examiner*—Peter A. Nelson
*Attorney, Agent, or Firm*—Law Office of Victor E. Libert; Victor E. Libert; Frederick A. Spaeth

[57] ABSTRACT

The manufacture of a signal transmission tube (10*a*) comprising a polymeric tube (12) having an interior surface (14) with a thin layer of reactive material (18) disposed on the interior surface (14) is rendered more efficient and less costly by the use of reclaim polymeric material obtained from pre-existing signal transmission tubes. The reclaim material is obtained by deactivating the pre-existing tube, e.g., by initiating a signal in the tube to deactivate the reactive material. Alternatively, deactivation may be achieved by thermally degrading the reactive material or physically removing the material from the interior of the pre-existing tube. The reclaim material is then used to extrude the new tube (12), reducing the consumption of virgin polymeric material. When the reclaim material is obtained from a multi-layered tube, it may comprise a blend of polymeric materials and may advantageously be used as a tie layer (26) between layers (20', 24') that comprise materials present in the blend.

14 Claims, 1 Drawing Sheet

SIGNAL TRANSMISSION TUBE USING RECLAIM MATERIAL AND METHOD OF MANUFACTURE

BACKGROUND OF THE INVENTION

1. Field of the Invention

The present invention relates to an improved method for manufacturing signal transmission tubes, and in particular to the materials used to manufacture such tubes.

2. Related Art

A signal transmission tube, occasionally referred to herein simply as a "tube", conventionally comprises an extruded, flexible plastic (i.e., polymeric) tube having a reactive material in the form of a layer of fine powder disposed on the interior wall of the tube, leaving hollow the central bore of the tube. The reactive material is ignited to propagate a signal through the tube to initiate an explosive device such as a detonator cap.

A variety of polymeric materials are known for use in the manufacture of signal transmission tubes. For example, U.S. Pat. No. 3,590,739 to Persson, dated Jul. 6, 1971, discloses a monotube, i.e., single ply or single layer tube, shock tube made of polyvinyl chloride; U.S. Pat. No. 5,166,470 to Stewart, dated Nov. 24, 1992, discloses a monotube shock tube made principally of polyethylene. It is also known to use polymeric blends in manufacturing signal transmission tubes, e.g., as indicated in U.S. Pat. No. 4,607,573 to Thureson et al, dated Aug. 26, 1986, at column 3, lines 17 through 23.

Typically, signal transmission tube is formed of a multi-layer tube. For example, U.S. Pat. No. 4,328,753 to Kristensen et al, dated May 11, 1982, shows the cross section of a dual layer tube comprising an outer layer surrounding an inner layer on the inner surface of which a coating of reactive powder adheres. The Patent teaches that the outer layer comprises a material selected from polyamide ("nylon"), polypropene, polybutene and the like, to provide a tensile strength of not less than 35 MPa, and the inner layer comprises a material that provides superior surface adhesion for the reactive material in the tube, specifically, particular SURLYN™ materials. Multi-ply tubes can be formed by tandem extrusion, i.e., by extruding an outer layer over a pre-existing tube, using distinct extruder stations, or by co-extrusion as shown in U.S. Pat. No. 5,212,341 to Osborne et al, dated May 18, 1993, in which the plies are formed substantially simultaneously using a crosshead die.

In signal transmission tubes referred to as "shock tubes", the reactive powder comprises a pulverulent high explosive material, e.g., PETN or HMX and aluminum powder, yielding a high velocity of signal propagation through the tube. In tubes referred to as "low velocity signal tubes", the reactive material comprises a deflagrating material such as molybdenum/potassium perchlorate, silicon/red lead, etc., as set forth, e.g., in U.S. Pat. No. 4,757,764 to Thureson et al, dated Jul. 19, 1988.

As the signal is transmitted through a signal transmission tube, the tube is deactivated, leaving an inert polymeric tube carcass.

SUMMARY OF THE INVENTION

The present invention relates to a method for manufacturing a signal transmission tube. The method comprises forming a hollow tube from polymeric material that comprises reclaim polymeric material. The reclaim polymeric material is obtained by deactivating a pre-existing signal transmission tube. The hollow tube has an interior surface, and the method further comprises disposing a layer of reactive material on the interior surface of the tube.

According to one aspect of the invention, the method may comprise blending the reclaim polymeric material with virgin polymeric material.

According to another aspect of the invention, forming hollow tube may comprise forming a plurality of concentric tube layers comprising polymeric materials, and at least one layer comprises the reclaim polymeric material.

Optionally, the method comprises disposing the at least one layer comprising the reclaim polymeric material as an intermediate layer between two adjacent layers. In such case, the intermediate layer preferably comprises a polymeric material of the type as in at least one adjacent layer, and more preferably, comprises a blend of the polymeric materials in the two adjacent layers.

The present invention also relates to signal transmission tubes formed according to the method described above.

DETAILED DESCRIPTION OF THE INVENTION AND PREFERRED EMBODIMENTS THEREOF

Figure 1:
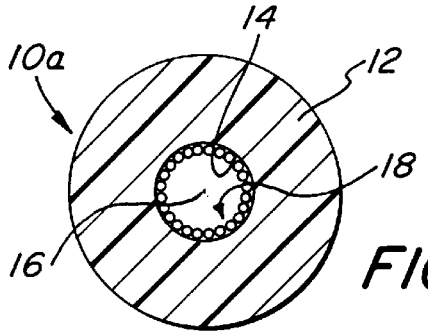
FIG. 1 is a cross-sectional view of a single layer signal transmission tube manufactured in accordance with the present invention.

The present invention relates to a method for the manufacture of signal transmission tubes that reduces raw material consumption and waste disposal costs associated with the manufacture and use of such tubes. The method makes use of waste product generated during manufacturing and it might be used to recycle the carcasses of previously used signal transmission tubes provided such material is properly stripped of contaminants picked up in the field. Signal transmission tubes according to the present invention can be manufactured using the same extrusion apparatus used for conventional signal transmission tubes.

Conventionally, signal transmission tubes are manufactured using "virgin" polymeric materials, i.e., polymeric materials that are purchased directly from a manufacturer, usually in granular form suitable for extrusion. The virgin polymeric material is melted for extrusion to form a hollow tube in one or more tube layers. While the tube is being extruded, a small quantity of powdered reactive material is blown into the interior of the tube. The powder adheres to the inner surface of the tube, leaving the central bore hollow. A typical loading of reactive material in a tube having an inner diameter of 1.14 millimeters (0.045 inches) is about 14 milligrams per linear meter of tube.

The manufacturing process for signal transmission tube engenders a certain amount of waste signal transmission tube material, especially during the start-up period before steady state manufacturing conditions are attained. In addition, occasional variations occur during steady state operation, e.g., variations in the core load of reactive material, that make certain quantities of finished product unacceptable for sale as a commercial product. The cost of the commercial product must be elevated to cover the cost of unsold waste signal transmission tube, as well as the cost of disposing of such waste.

The present invention enhances the efficiency of the manufacture and use of signal transmission tubes by reclaiming polymeric material from commercially unacceptable pre-existing, i.e., previously manufactured, tubes for use in the manufacture of new signal transmission tubes. In this way, the costs associated with the unavoidable production of waste during the manufacturing process are at least partially recovered, and the need to arrange for disposal of the waste material is alleviated.

In accordance with the present invention, the polymeric material used to form a signal transmission tube comprises, at least in part, but optionally exclusively, reclaim polymeric material from pre-existing, i.e., previously produced, signal transmission tubes. The reclaim material is obtained by deactivating the previously produced signal transmission tube so that it is non-reactive. Deactivation can be accomplished in a number of ways including initiating a signal in the tube. This can be easily and safely done by inserting an open end of the tube in a device that produces a spark at the open end to ignite the reactive material in the tube. Preferably, the other end of the tube is muffled so that the signal omitted therefrom does not cause injury, damage or unwanted noise. Another method of deactivating a pre-existing signal transmission tube is to heat the tube to a temperature at which the reactive material therein degrades. In such a process, the polymeric material must be protected from being oxidized and degraded, and this may be accomplished by heating the material to be reclaimed in an inert atmosphere, such as in nitrogen. Still other methods include flowing a solvent for the reactive material through the tube so that the interior of the tube is washed clean and then flushing out the solvent and drying the tube; and mechanically dislodging the reactive material from the tube, e.g., by vibrating the tube, blowing an inert gas through the tube, etc.

Preferably, once the pre-existing signal transmission tube is deactivated, it is chopped into granules sized to facilitate feeding the reclaim material to an extruder. The reclaim material may be used in place of, or may be intermixed with, virgin polymeric material for use in the manufacture of a signal transmission tube or a layer thereof. The tube or tube layer may thus comprise reclaim material or a blend of reclaim material with virgin material. In this way, the quantity of virgin polymeric material required to produce the signal transmission tube is reduced. As used herein and in the claims, the term "blend" is intended to encompass homogeneous solutions of polymeric materials as well as multiphase mixtures of the materials.

When reclaim material is obtained from a multi-layer signal transmission tube and is melted for extrusion into a new signal transmission tube, the reclaim material will comprise a blend of the various polymeric materials used in the layers of the pre-existing signal transmission tube. Accordingly, it may be advantageous to use the reclaim material as an intermediate layer between layers of polymeric materials similar to those in the reclaim blend. For example, if the reclaim material comprises a blend of SURLYN™ ionomer and a polyolefin such as polyethylene, it may be advantageously disposed at an intermediate layer between an inner layer of SURLYN™ ionomer and an outer layer of polyethylene.

FIG. 1 is a cross-sectional view of a signal transmission tube in accordance with one embodiment of the present invention. The signal transmission tube 10*a* is a single layer tube or monotube comprising a single layer 12 of polymeric material having an interior surface 14. Interior surface 14 defines a central bore 16 of the tube 10*a* that extends longitudinally therethrough and has a thin layer of reactive material 18 disposed thereon.

Figure 2A:
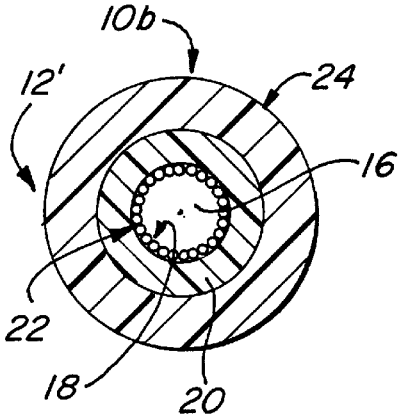
FIG. 2A is a cross-sectional view of a dual layer tube in accordance with the present invention.
Figure 2B:
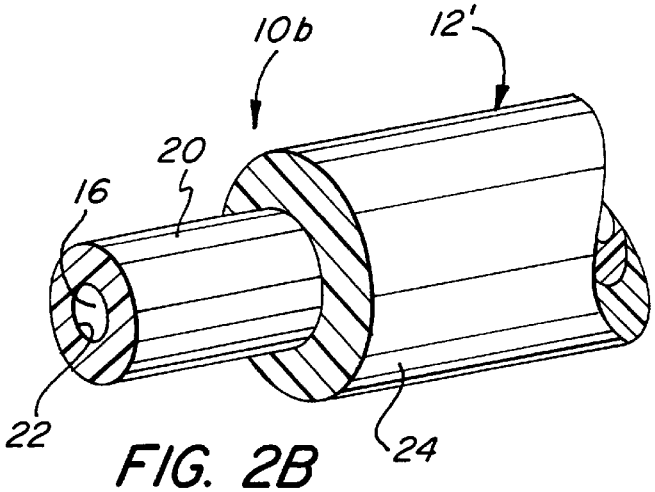
FIG. 2B is a perspective, partly sectional view of the tube of FIG. 2A.

A signal transmission tube 10*b* shown in FIGS. 2A and 2B comprises a dual layer polymeric tube 12'. Tube 12' comprises an inner layer 20 having an inner surface 22 that defines the central bore 16 that extends longitudinally through the tube 12'. Inner surface 22 has a thin layer of reactive material 18 (not shown in FIG. 2B) thereon. Inner layer 20 is formed from virgin SURLYN™ material. Outer layer 24 of polymeric tube 12' is extruded over inner layer 20 and comprises reclaim material. Preferably, the reclaim material in outer layer 24 is obtained from a pre-existing dual layer tube having a SURLYN™ ionomer inner layer and a polyethylene outer layer so that the reclaim material is a blend of SURLYN™ and polyethylene with polyethylene predominating in the blend. The SURLYN™ component of the reclaim material will improve the adhesion between the outer layer and the inner layer and will thus prevent delamination during processing, storage and deployment of the tube. Optionally, outer layer 24 may comprise a blend of reclaim material and virgin polymeric material.

Figure 3A:
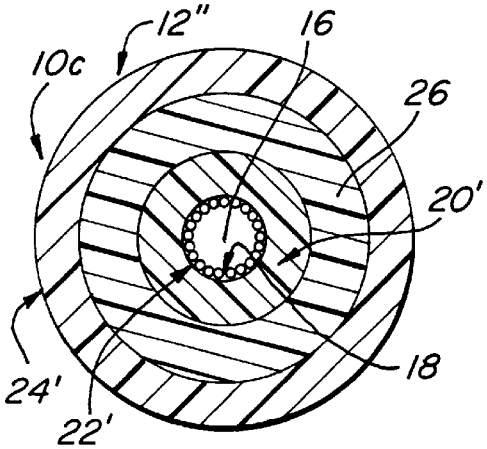
FIG. 3A is a cross-sectional view of a three-layered tube in accordance with the present invention.
Figure 3B:
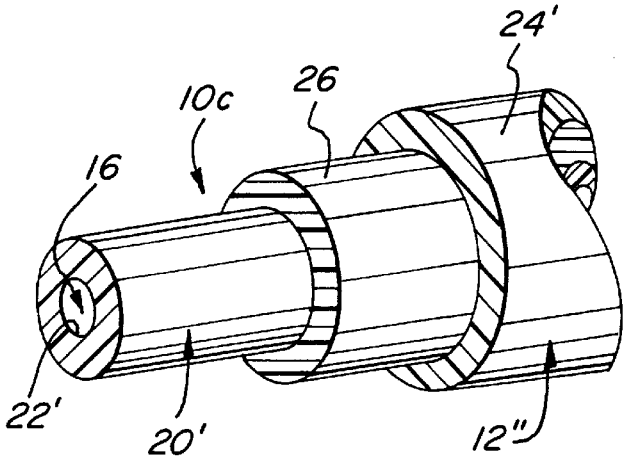
FIG. 3B is a perspective, partly sectional view of the tube of FIG. 3A.

The signal transmission tube 10*c* of FIGS. 3A and 3B comprises a three-layered polymeric tube 12" that comprises an inner layer 20' of SURLYN™ ionomer having an interior surface 22' (FIG. 3B) that has a thin layer of reactive material 18 (FIG. 3A) thereon and which defines a central bore 16 that extends longitudinally through the tube. Tube 10C comprises an outer layer 24' comprising polyethylene and an intermediate layer 26 disposed between, and in contact with, inner layer 20' and outer layer 24', which are adjacent to intermediate layer 26. Intermediate layer 26 comprises reclaim polymeric material and preferably comprises a blend of the polymeric materials that comprise inner layer 20' and outer layer 24' adjacent thereto. Thus, intermediate layer 26 can be expected to serve as a tie layer, i.e., to adhere the adjacent layers 20' and 24' together and to inhibit delamination of the layers. For example, if inner layer 20' comprises SURLYN™ material and outer layer 24' comprises polyethylene, intermediate layer 26 preferably comprises reclaim material that comprises a blend of SURLYN™ material and polyethylene. Such reclaim material can be recovered from a pre-existing dual-layered transmission tube having an inner layer comprising SURLYN™ material and an outer layer comprising polyethylene. Intermediate layer 26 may be employed principally for its binding properties as a tie layer and may therefore be quite thin, e.g., it may have a thickness of 1 to 3 millimeters.

While the invention has been described in detail with reference to particular embodiments thereof, it will be apparent upon a reading and understanding of the foregoing that numerous alterations to the described embodiments will occur to those skilled in the art, and it is intended to include such alterations within the scope of the appended claims.

What is claim is:

1. A method for manufacturing a signal transmission tube comprising:

forming a hollow tube from a polymeric material that comprises reclaim polymeric material obtained by deactivating a pre-existing signal transmission tube, the hollow tube having an interior surface, the method further comprising disposing a layer of reactive material on the interior surface of the hollow tube.

2. The method of claim 1 comprising blending the reclaim polymeric material with virgin polymeric material.

3. The method of claim 1 or claim 2 wherein forming a hollow tube comprises forming a plurality of concentric tube layers comprising polymeric materials and wherein at least one layer comprises the reclaim polymeric material.

4. The method of claim 3 comprising disposing the at least one layer comprising the reclaim polymeric material as an intermediate layer between two adjacent layers.

5. The method of claim 4 wherein the intermediate layer comprises a polymeric material of the type in at least one adjacent layer.

6. The method of claim 5 wherein the intermediate layer comprises a blend of the polymeric materials in the two adjacent layers.

7. A signal transmission tube comprising a hollow tube comprising reclaim polymeric material obtained by deactivating a pre-existing signal transmission tube, the hollow tube having an interior surface, the signal transmission tube further comprising a layer of reactive material disposed on the interior surface of the hollow tube.

8. The signal transmission tube of claim 7 wherein the hollow tube further comprises virgin polymeric material.

9. The signal transmission tube of claim 7 or claim 8 wherein the hollow tube comprises a plurality of concentric layers, each layer comprising a polymeric material and wherein at least one layer comprises the reclaim polymeric material.

10. The signal transmission tube of claim 9 wherein the at least one layer comprising the reclaim polymeric material is an intermediate layer disposed between two adjacent layers.

11. The signal transmission tube of claim 10 wherein the intermediate layer comprises polymeric material of the same type as in at least one adjacent layer.

12. The signal transmission tube of claim 11 wherein the intermediate layer comprises a blend of the polymeric materials of the two adjacent layers.

13. The signal transmission tube of claim 11 wherein the reclaim polymeric material comprises a blend of polymeric materials comprising an ionomer polymer and a polyolefin.

14. The signal transmission tube of claim 12 wherein the reclaim polymeric material comprises a blend of polymeric materials comprising an ionomer polymer and a polyolefin.

* * * * *